US008292289B2

(12) United States Patent
Kotaka et al.

(10) Patent No.: US 8,292,289 B2
(45) Date of Patent: Oct. 23, 2012

(54) TRANSPORT DEVICE, IMAGE READING DEVICE, AND IMAGE FORMING APPARATUS

(75) Inventors: Toshikazu Kotaka, Shiojiri (JP); Yosaku Tamura, Matsumoto (JP); Seiji Kawabata, Matsumoto (JP); Kensuke Tamai, Shiojiri (JP); Hidetoshi Kodama, Matsumoto (JP); Soichiro Kii, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 41 days.

(21) Appl. No.: 12/533,403

(22) Filed: Jul. 31, 2009

(65) Prior Publication Data

US 2010/0025927 A1 Feb. 4, 2010

(30) Foreign Application Priority Data

Aug. 1, 2008 (JP) ..... 2008-199809

(51) Int. Cl.
*B65H 3/06* (2006.01)

(52) U.S. Cl. ..... 271/117

(58) Field of Classification Search ..... 271/117, 271/118, 121, 245, 246, 145, 265.01, 258.01, 271/258.02, 114, 176, 167, 243, 244, 10.02, 271/10.03, 4.02, 4.03; 221/14, 17
See application file for complete search history.

(56) References Cited

U.S. PATENT DOCUMENTS

| | | | | |
|---|---|---|---|---|
| 3,186,325 | A * | 6/1965 | De Belder | 396/581 |
| 6,738,596 | B2 | 5/2004 | Kamimura et al. | |
| 6,792,241 | B2 * | 9/2004 | Nakagawa et al. | 399/367 |
| 6,978,113 | B2 | 12/2005 | Kamimura et al. | |
| 7,651,082 | B2 * | 1/2010 | Hendrix et al. | 271/121 |
| 2006/0049572 | A1 | 3/2006 | Miyazawa | |

FOREIGN PATENT DOCUMENTS

| | | | |
|---|---|---|---|
| JP | 3-211140 | * | 9/1991 |
| JP | 2003-155133 | | 5/2003 |

* cited by examiner

*Primary Examiner* — Gerald McClain
*Assistant Examiner* — Thomas Morrison
(74) *Attorney, Agent, or Firm* — Maschoff Gilmore & Israelsen

(57) ABSTRACT

A transport device, which transports a sheet set in a set section toward the downstream side on a transport path, includes a restricting member. The restricting member is provided at a set position of the sheet in the set section, and is displaced to restrict the sheet moving toward the downstream side on the transport path. The restricting member includes a restricting section that comes in contact with a front end of the sheet from the downstream side on the transport path, and is rotatable about a shaft extending along the transport path so as to be displaced between a first position where the restricting section protrudes on the transport path and a second position where the restricting section retracts from the transport path.

6 Claims, 7 Drawing Sheets

TRANSPORT DEVICE, IMAGE READING DEVICE, AND IMAGE FORMING APPARATUS

BACKGROUND

1. Technical Field

The present invention relates to a transport device that transports, for example, a sheet such as a paper, an image reading device that reads an image recorded on a sheet transported by a transport device, and an image forming apparatus that records an image read by the image reading device.

2. Related Art

In the past, an image forming apparatus disclosed in JP-A-2003-155133 has been known as an example of an image forming apparatus that forms an image on a sheet transported by a transporter (transport device). The image forming apparatus disclosed in JP-A-2003-155133 is provided with a restricting lever (restricting member) that makes the following sheet stop and stand by at a predetermined set position in order to keep a predetermined gap between the preceding sheet and the following sheet when a plurality of sheets stacked in a paper feed section (set section) is sequentially transported one by one by the transporter toward the downstream side in a transport direction of the sheet.

The restricting lever is rotatable about a rotating shaft (shaft) that extends in a direction orthogonal to the transport direction of the sheet. The restricting lever is rotated and pushed by a push spring (pusher) so as to be positioned at a position (first position) where the end of the restricting lever always protrudes upward from a transport path of the sheet. Further, when the following sheet stopped by the restricting lever begins to be transported toward the downstream side, an electromagnetic solenoid used as an actuator is activated. Accordingly, the restricting lever is rotated against the pushing force of the push spring so as to be positioned at a position (second position) where the end of the restricting lever is retracted from the transport path of the sheet.

Meanwhile, since the restricting lever is rotatable about the rotating shaft extending in a direction orthogonal to the transport direction of the sheet in the image forming apparatus disclosed in JP-A-2003-155133, the stopping force of the restricting lever, which is positioned in the first position, for stopping the following sheet depends on the elastic force of the push spring. For this reason, when the following sheet is pushed toward the downstream side of the set position in the transport direction by a pushing force that is larger than the elastic force of the push spring and caused by, for example a user's manual operation, the restricting lever is rotated by the pushing force so as to be positioned at the second position. Further, in that case, there are concerns that the front end of the sheet gets over the restricting lever, gets past the set position toward the downstream side, and is not stopped at the set position.

SUMMARY

An advantage of some aspects of the invention is to provide a transport device that can reliably restrict the front end of a sheet from getting past the set position toward the downstream side in a set section by a rotary restricting member when the sheet is set in the set section, an image reading device, and an image forming apparatus.

According to an aspect of the invention, there is provided a transport device that transports a sheet set in a set section toward the downstream side on a transport path. The transport device includes a restricting member that is provided at a set position of the sheet in the set section and is displaced to restrict the sheet moving toward the downstream side on the transport path. The restricting member includes a restricting section that comes in contact with the front end of the sheet from the downstream side on the transport path, and is able to rotate about a shaft extending along the transport path so as to be displaced between a first position where the restricting section protrudes onto the transport path and a second position where the restricting section is retracted from the transport path.

According to this structure, the restricting member is rotatable about the shaft extending along the transport path. Accordingly, even though the sheet is strongly pushed toward the downstream side of the set position in the transport direction by, for example a user's manual operation or the like, the pushing force is not applied to the restricting member, which is positioned at the first position, in a rotational direction. For this reason, a restricting force, for restricting the front end of the sheet from progressing against the pushing force toward the downstream side of the transport path beyond the set position, depends on the strength of the material of the restricting member. Therefore, when the sheet is set in the set section, it may be possible by using the rotary restricting member to reliably restrict the front end of the sheet from progressing toward the downstream side of the transport path beyond the set position in the set section.

In the transport device according to the aspect of the invention, the restricting section may cross the transport path in a thickness direction of the sheet set in the set section when the restricting member is positioned at the first position.

According to this structure, when the restricting member is positioned at the first position, the restricting section blocks the transport path in the thickness direction of the sheet without leaving a gap. Accordingly, it may be possible to further reliably restrict the front end of the sheet from progressing toward the downstream side of the transport path beyond the set position in the set section.

In the transport device according to the aspect of the invention, a recess, into which an end of the restricting section is inserted when the restricting member is positioned at the first position, may be formed at the set position of the set section.

According to this structure, even though the restricting section is deformed by the pushing force that is applied from the sheet when the restricting member is positioned at the first position, the end of the restricting section may be engaged with the side surface of the recess. Accordingly, it may be possible to suppress the deformation of the restricting section, that is, to reinforce the restricting section.

The transport device according to the aspect of the invention may further include a feeding member that feeds the sheet set in the set section toward the downstream side on the transport path, and a pusher that pushes the restricting member so that the restricting member is positioned at the first position. The feeding member may be displaced between a feed position where the feeding member feeds the sheet and a non-feed position where the feeding member does not feed the sheet. When the feeding member is displaced from the non-feed position to the feed position, the feeding member may be engaged with the restricting member so as to push the restricting member against the pushing force of the pusher so that the restricting member is positioned at the second position.

According to this structure, when the feeding member is displaced to the feed position, the restricting member is positioned at the second position, so that the restricting section reliably retracts from the transport path of the sheet. Therefore, it may be possible to smoothly feed the sheet, which is set in the set section, toward the downstream side of the set position on the transport path by the feeding member.

According to another aspect of the invention, there is provided an image reading device that includes the transport device that has the above-mentioned structure and a reading unit that reads an image recorded on the sheet transported by the transport device.

According to this structure, it may be possible to obtain the same advantages as the transport device.

According to another aspect of the invention, there is provided an image forming apparatus that includes the image reading device that has the above-mentioned structure and a recording unit that records an image read by the image reading device.

According to this structure, it may be possible to obtain the same advantages as the transport device.

BRIEF DESCRIPTION OF THE DRAWINGS

The invention will be described with reference to the accompanying drawings, wherein like numbers reference like elements.

DESCRIPTION OF EXEMPLARY EMBODIMENTS

An image forming apparatus according to an embodiment of the invention, which is applied to a complex machine, will be described below with reference to drawings. Meanwhile, in the following description, a "longitudinal direction", a "width direction", and a "vertical direction" respectively represent the longitudinal direction, the width direction, and the vertical direction, which are indicated by arrows in FIG. 1.

Figure 1:
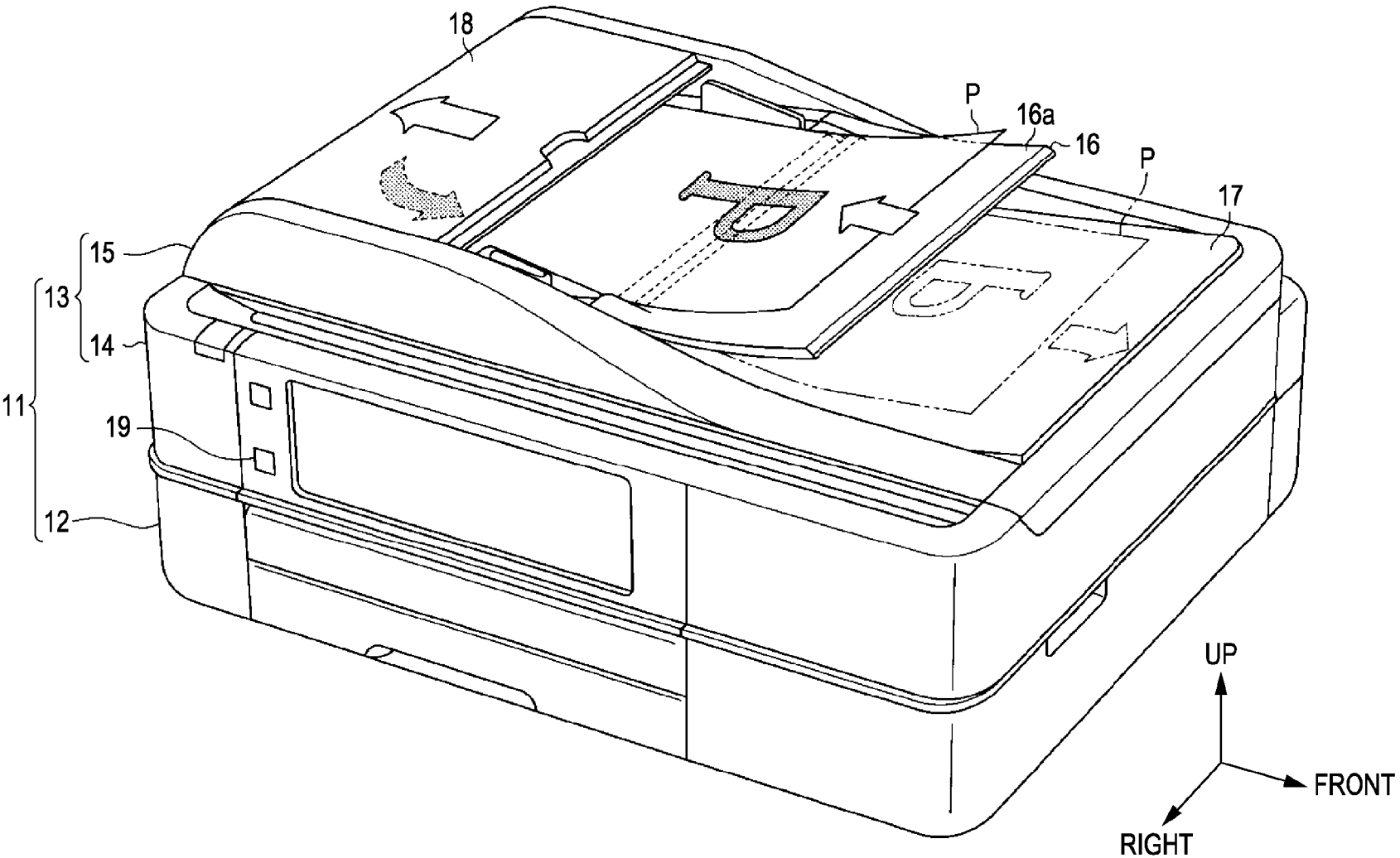
FIG. 1 is a perspective view of a complex machine according to an embodiment of the invention.

As shown in FIG. 1, a complex machine 11 used as an image forming apparatus includes a printer unit 12 that functions as a recording unit, and a scanner device 13 that functions as an image reading device and is disposed on the printer unit 12. The complex machine has a substantially rectangular parallelepiped shape. The scanner device 13 includes a scanner unit 14 that functions as a reading unit, and a transport unit 15 that functions as a transport device and is disposed on the scanner unit 14.

The transport unit 15 includes a paper feed tray 16 that functions as a set section in which a plurality of paper sheets P used as sheets can be set in a stacked state, and a paper discharge tray 17 that is positioned below the paper feed tray 16. The paper feed tray 16 is inclined downward toward the rear side, and the upper surface of the paper feed tray functions as a set face 16*a* on which paper sheets P are set. A reverse cover 18, which covers the rear portion of the paper feed tray 16, is provided at the upper rear end of the transport unit 15 so as to be freely opened and closed.

When a user operates a start switch 19 provided on the right surface of the scanner unit 14, the paper sheets P set on the set face 16*a* of the paper feed tray 16 positioned one by one upstream on a transport path of the paper sheet P are transported to the paper discharge tray 17, which is positioned downstream on the transport path.

In this case, an image (character "P" in this embodiment) is recorded on the upper surface of each of the paper sheets P that are set on the set face 16*a* of the paper feed tray 16. The paper sheet is reversed while being transported, and the image is read by the scanner unit 14. Then, the paper sheet is discharged onto the paper discharge tray 17 so that the surface of the sheet paper on which the image is printed faces the lower side. Further, the image read by the scanner unit 14 is printed on an unused paper sheet (not shown) by the printer unit 12.

Figure 2:
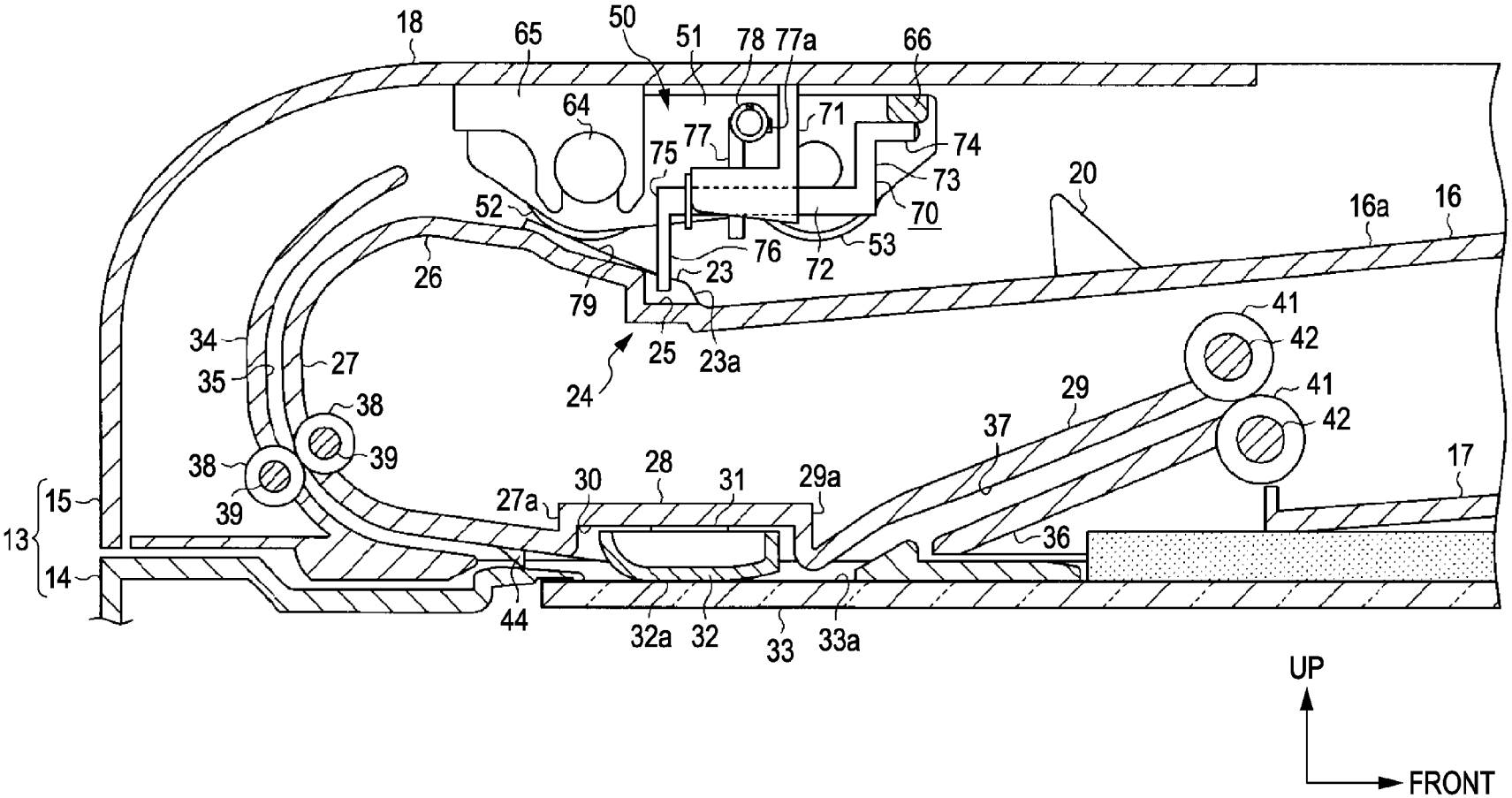
FIG. 2 is a schematic cross-sectional view of main parts of the complex machine.

As shown in FIG. 2, a first detection lever 20, which is used as a detection member having the shape of a right triangle of which the front side (as seen in the width direction) is an oblique side, is provided on the set face 16*a* near the rear portion of the paper feed tray 16 so as to freely extend back and forth from the lower side. The first detection lever 20 is pushed by a spring (not shown), which is provided in the paper feed tray 16, so as to always protrude upward from the set face 16*a*. Accordingly, if a paper sheet P is set on the set face 16*a*, the first detection lever retracts into the paper feed tray 16 against the pushing force of the spring (not shown) due to the weight of the paper sheet P (due to the pressure applied from the paper sheet P).

Further, a first detection part 21 (see FIG. 6) which detects whether the first detection lever 20 retracts into the paper feed tray 16, is provided in the paper feed tray 16. If the first detection lever 20 retracts into the paper feed tray 16, the first detection part 21 (see FIG. 6) outputs an ON-detection signal. If the first detection lever 20 does not retract into the paper feed tray 16, the first detection part outputs an OFF-detection signal.

That is, in general, the first detection part 21 (see FIG. 6) outputs an ON-detection signal when the paper sheet P is set on the set face 16*a*, and outputs an OFF-detection signal when there is no paper sheet P on the set face 16*a*. Meanwhile, in this embodiment, a paper sheet detecting sensor 22 (see FIG. 6) used as a sheet sensor is formed of the first detection lever 20 and the first detection part 21 (see FIG. 6).

Figure 3:
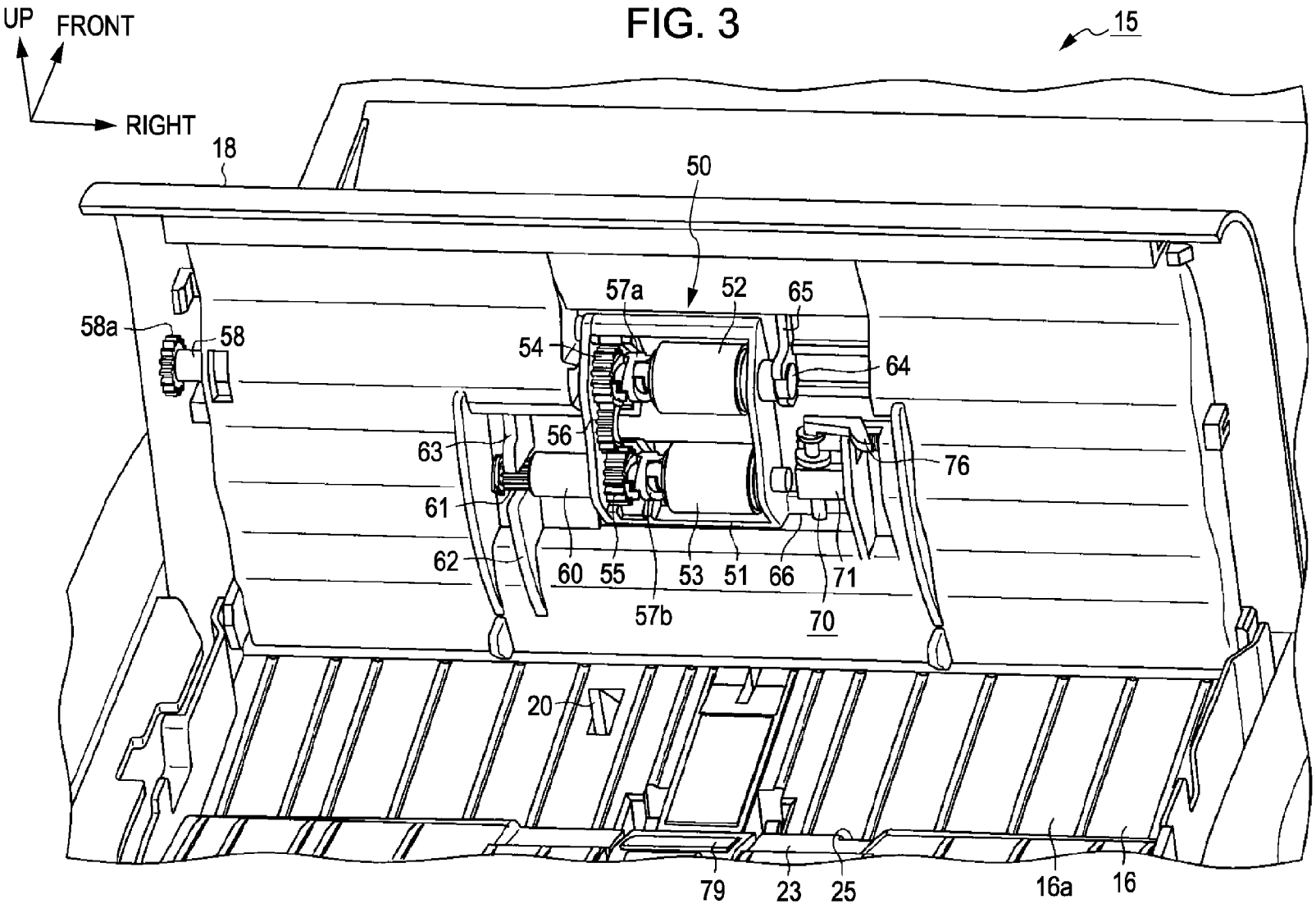
FIG. 3 is an enlarged perspective view of the main parts when a reverse cover of a transport unit is opened.

As shown in FIGS. 2 and 3, a stepped portion 23 including a slope 23*a* is formed at the rear end of the paper feed tray 16. When the paper sheet P is set on the set face 16*a*, the end (rear end) of the paper sheet P comes in contact with the slope so that the paper sheet P is set into position. The stepped portion 23 extends over the entire width of the paper feed tray 16 in the width direction of the paper feed tray, and the slope 23*a* inclined upward toward the rear side. A position, where the front end of the paper sheet P is positioned in the longitudinal direction when the paper sheet P is set on the set face 16*a*, is referred to as a set position 24, and the stepped portion 23 is positioned at the set position 24.

A recess 25, which has opened upper and front sides, is formed at a portion of the stepped portion 23 that is slightly closer to the right side than the middle of the stepped portion in the width direction. A transport path forming member 26, which forms the transport path of the paper sheet P, is integrally connected to the stepped portion 23 on the rear side of the stepped portion 23. The transport path forming member 26 includes a paper feeding guide section 27, an opposite section 28, and a paper discharging guide section 29. The paper feeding guide section is curved in a U shape so as to rise rearward from the stepped portion 23, extends toward the lower end of the transport unit 15, and then extends forward along the upper surface of the scanner unit 14. The opposite section faces an upper surface 33*a* of a glass 33 that is horizontally disposed at the upper end of the scanner unit 14 and horizontally extends forward. The paper discharging guide section extends substantially in a straight line so as to be inclined upward toward the front side from the opposite section 28.

That is, bent portions 27*a* and 29*a*, which are formed by bending upward the lower ends of the paper feeding guide section 27 and the paper discharging guide section 29 in a vertical direction, are respectively formed at the lower ends of the paper feeding guide section 27 and the paper discharging guide section 29. The upper ends of the bent portions 27*a* and 29*a* are connected to each other by the opposite section 28. Accordingly, an opposite recess 30, which includes the opposite section 28 as a bottom and is opened at the lower portion thereof, is formed by the opposite section 28 and the bent portions 27*a* and 29*a*. A paper sheet pressing member 32 is provided in the opposite recess 30, that is, on the lower surface of the opposite section 28 with a spring 31 interposed therebetween so as to extend in the width direction. The paper sheet pressing member 32 has a substantially U shape in cross-sectional view, and the lower end surface 32*a* of the paper sheet pressing member forms a horizontal surface. Further, the lower end surface 32*a* of the paper sheet pressing member 32 is always pressed against the upper surface 33*a* of the glass 33 by the pushing force of the spring 31.

A paper feed guide 34, which extends along the paper feeding guide section 27, is provided on the rear side of the paper feeding guide section 27 of the transport path forming member 26 in the transport unit 15. A gap formed between the paper feed guide 34 and the paper feeding guide section 27 serves as a paper feed passage 35 that forms a part of the transport path of the paper sheet P. A pair of paper feed rollers 38, which pinches the paper sheet P passing through the paper feed passage 35 and feeds the paper sheet toward the downstream side, is provided at a position, which is close to the downstream side on the paper feed passage 35, so as to each rotate about rotating shafts 39 that extend in the width direction. Each of the rotating shafts 39 is rotationally driven by a paper feed motor 40 (see FIG. 6) that is provided in the transport unit 15. Accordingly, if the paper feed motor 40 (see FIG. 6) is driven, each of the paper feed rollers 38 is rotationally driven together with each of the rotating shafts 39.

Meanwhile, a paper discharge guide 36, which extends along the discharging guide section 29, is provided below the paper discharging guide section 29 of the transport path forming member 26 in the transport unit 15. A gap formed between the paper discharge guide 36 and the paper discharging guide section 29 serves as a paper discharge passage 37 that forms a part of the transport path of the paper sheet P. A pair of paper discharge rollers 41, which pinches the paper sheet P passing through the paper discharge passage 37 and feeds the paper sheet toward the paper discharge tray 17, is provided at the downstream end of the paper discharge passage 37 so as to each rotate about rotating shafts 42 that extend in the width direction. Each of the rotating shafts 42 is rotationally driven by a paper discharge motor 43 (see FIG. 6) that is provided in the transport unit 15. Accordingly, if the paper discharge motor 43 (see FIG. 6) is driven, each of the paper discharge rollers 41 is rotationally driven together with each of the rotating shafts 42.

Further, a second detection lever 44, which has the shape of a right triangle of which the rear side (herein, a side corresponding to the upstream side of the paper sheet P) (as seen in the width direction) is an oblique side, is provided on the transport path of the paper sheet P at the lower end of the paper feeding guide section 27 of the transport path forming member 26 so as to freely extend back and forth from the upper side. The second detection lever 44 is pushed by a spring (not shown), which is provided in the paper feeding guide section 27, so as to always protrude upward from the transport path of the paper sheet P. Accordingly, if being pressed forward (toward the downstream side of the paper sheet P) by the front end of the paper sheet P transported on the transport path, the second detection lever retracts into the paper feeding guide section 27 against the pushing force of the spring (not shown).

Further, a second detection part 45 (see FIG. 6), which detects whether the second detection lever 44 retracts into the paper feeding guide section 27, is provided in the paper feeding guide section 27. If the second detection lever 44 retracts into the paper feeding guide section 27, the second detection part 45 (see FIG. 6) outputs an ON-detection signal. If the second detection lever 44 does not retract into the paper feeding guide section 27, the second detection part outputs an OFF-detection signal. Meanwhile, in this embodiment, a paper sheet-end sensor 46 (see FIG. 6) is formed of the second detection lever 44 and the second detection part 45 (see FIG. 6).

As shown in FIGS. 2 and 3, a separation pad 79 is provided in the middle of the stepped portion 23 in the width direction, and the separation pad 79 is pushed upward by a spring (not shown). Further, a feed roller unit 50 functioning as a feeding member, which can feed the paper sheet P set on the set face 16*a* toward the downstream side, is swingably supported on the inner surface of the reverse cover 18 at a position facing the stepped portion 23.

Figure 4:
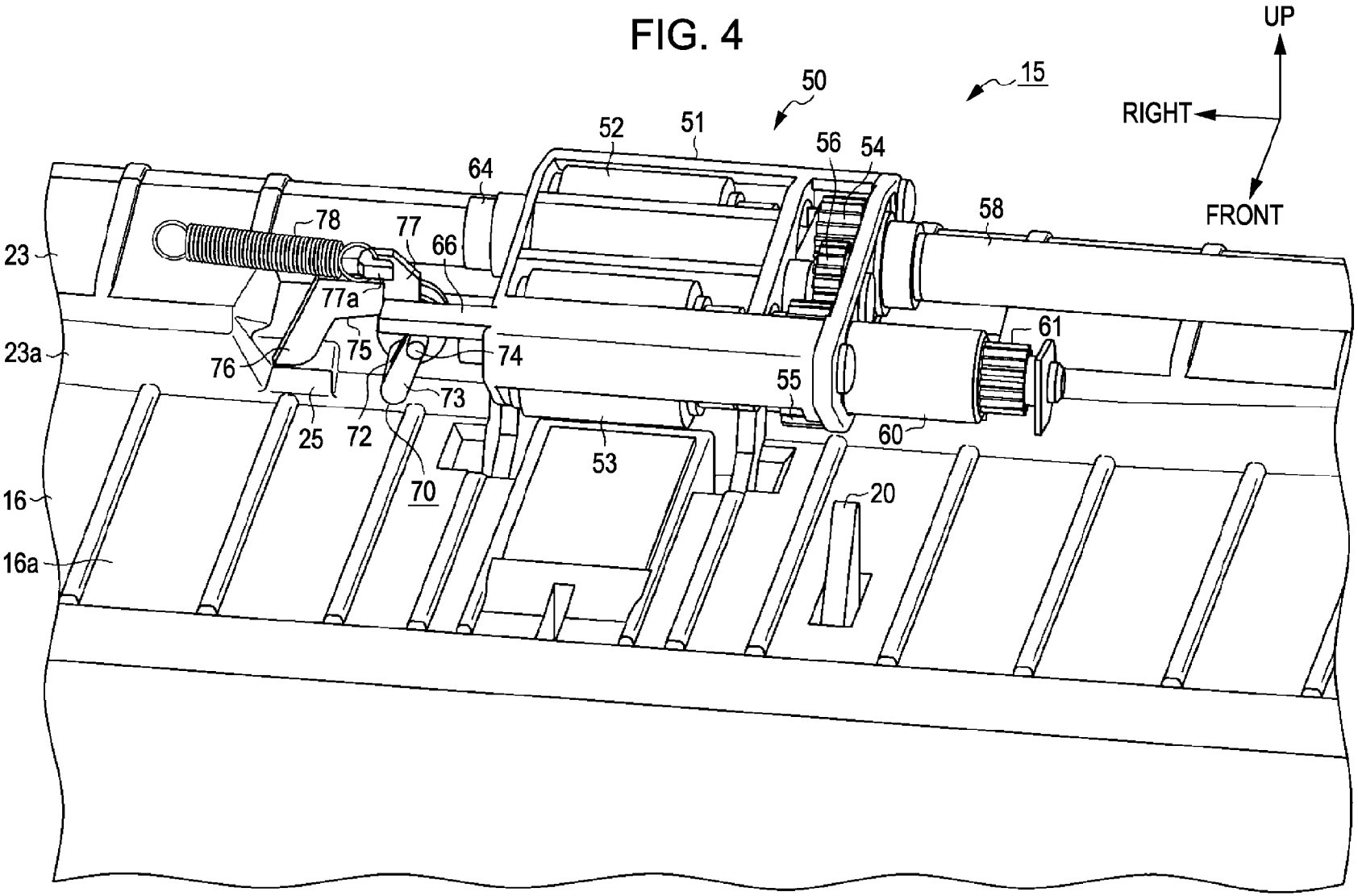
FIG. 4 is an enlarged perspective view of the main parts of the transport unit when the reverse cover is omitted and a feed roller unit is positioned at a non-feed position.

As shown in FIGS. 3 and 4, the feed roller unit 50 includes a frame 51 that has a substantially rectangular shape in plan view. First and second feed rollers 52 and 53 are rotatably supported in the frame 51 so as to make a pair, and are positioned parallel to each other in the longitudinal direction. That is, the first feed roller 52 is disposed on the rear side of the second feed roller 53 in the frame 51, and the first and second feed rollers are each rotatable about axes extending in the width direction. In this case, the first feed roller 52 is positioned so as to always come in contact with the upper surface of the separation pad 79.

In the frame 51, first and second gears 54 and 55 are rotatably supported on the left side of the first and second feed rollers 52 and 53. The first gear 54 and the first feed roller 52 are rotatable about the same axis, and the second gear 55 and the second feed roller 53 are rotatable about the same axis. Further, a transmission gear 56 is rotatably supported between the first and second gears 54 and 55 in the frame 51, and the transmission gear 56 meshes with the first and second gears 54 and 55.

A first one-way clutch 57*a* is provided between the first feed roller 52 and the first gear 54. When the first gear 54 is rotated in a normal direction (rotated clockwise in this embodiment as seen from the right side), the first one-way clutch 57*a* transmits the torque of the first gear 54 to the first feed roller 52. When the first gear 54 is rotated in a reverse direction (rotated counterclockwise in this embodiment as seen from the right side), the first one-way clutch does not transmit the torque of the first gear 54 to the first feed roller 52.

Likewise, a second one-way clutch 57*b*, which has exactly the same structure as the first one-way clutch 57*a*, is provided between the second feed roller 53 and the second gear 55. Accordingly, when the second gear 55 is rotated in the normal direction, the torque of the second gear 55 is transmitted to the second feed roller 53 by the second one-way clutch 57*b*. When the second gear 55 is rotated in the reverse direction, the torque of the second gear 55 is not transmitted to the second feed roller 53 by the second one-way clutch.

A main shaft 58, which extends in the width direction and is rotated about the axis of the first feed roller 52, is rotatably supported on the inner surface of the reverse cover 18. A right end of the main shaft 58 passes through the left wall of the frame 51 and is connected to the first gear 54. A main shaft gear 58*a* is fixed to the left end of the main shaft. The main shaft 58 and the first gear 54 are rotated about the same axis as a single body. The main shaft supports the left wall of the frame 51 while not interfering with the rotation thereof.

Further, the main shaft gear 58*a* of the main shaft 58 meshes with a motor gear (not shown) fixed to an output shaft (not shown) of the feeding motor 59 (see FIG. 6) which is provided in the transport unit 15, through a motor transmission gear (not shown). Accordingly, the feeding motor 59 is driven in the normal direction when the main shaft 58 is rotated in the normal direction, and is rotated in the reverse direction when the feeding motor 59 is driven in the reverse direction.

A sub-shaft 60 is connected to the second gear 55 from the left side, and the sub-shaft 60 and the second gear 55 are rotated about the same axis as a single body. The sub-shaft 60 passes through the left wall of the frame 51 and protrudes from the left side of the frame 51 toward the outside of the frame 51. A sub-shaft gear 61 is fixed to the end (left end) of the sub-shaft 60, and the left wall of the frame 51 does not interfere with the rotation of the sub-shaft gear. Further, the sub-shaft gear 61 is interposed in the longitudinal direction between front and rear support plates 62 and 63, which are provided on the inner surface of the reverse cover 18.

The surface of the front support plate 62, which faces the sub-shaft gear 61, comes in contact with and slides across the sub-shaft gear 61. Meanwhile, a rack (not shown), which extends in the vertical direction, is formed on the surface of the rear support plate 63 that faces the sub-shaft gear 61. The rack meshes with the sub-shaft gear 61. Accordingly, when the sub-shaft gear 61 (sub-shaft 60) is rotated in the normal direction, the sub-shaft gear 61 is moved down along the rack (not shown) of the rear support plate 63 while being rotated. When the sub-shaft gear 61 (sub-shaft 60) is rotated in the reverse direction, the sub-shaft gear 61 is moved up along the rack (not shown) of the rear support plate 63 while being rotated.

A covered cylindrical support 64 protrudes toward the right side from the outer surface of the right wall of the frame 51 at a position corresponding to the first feed roller 52. A step is formed at the support 64 so that the outer diameter of the end portion of the support is smaller than that of the base portion thereof. Accordingly, the end portion of the support is rotatably supported by the support member 65 that is provided on the inner surface of the reverse cover 18. In addition, an engagement arm 66, which extends toward the right side, is formed at the upper front end on the outer surface of the right wall of the frame 51.

Further, when the first and second feed rollers 52 and 53 are parallel to each other in a horizontal direction (see FIGS. 2 and 4), the position of the feed roller unit 50 is referred to as a non-feed position. When being positioned at the non-feed position, the feed roller unit does not feed the paper sheet P set on the set face 16*a* toward the downstream side of the transport path. That is, when the feed roller unit 50 is positioned at the non-feed position, the second feed roller 53 is separated upward from the set face 16*a* or the paper sheet P that is set on the set face 16*a*. Meanwhile, when the transport unit 15 is in a standby state, the feed roller unit 50 is generally positioned at the non-feed position.

Further, if the main shaft 58 is rotated in the normal direction when the feed roller unit 50 is positioned at the non-feed position, the first gear 54 is rotated in the normal direction. Accordingly, the transmission gear 56 is rotated in the reverse direction and the second gear 55 is rotated in the normal direction. In this case, the torque of the first and second gears 54 and 55 is respectively transmitted to the first and second feed rollers 52 and 53 by the first and second one-way clutches 57*a* and 57*b* so that the first and second feed rollers 52 and 53 are rotated in the normal direction.

Figure 5:
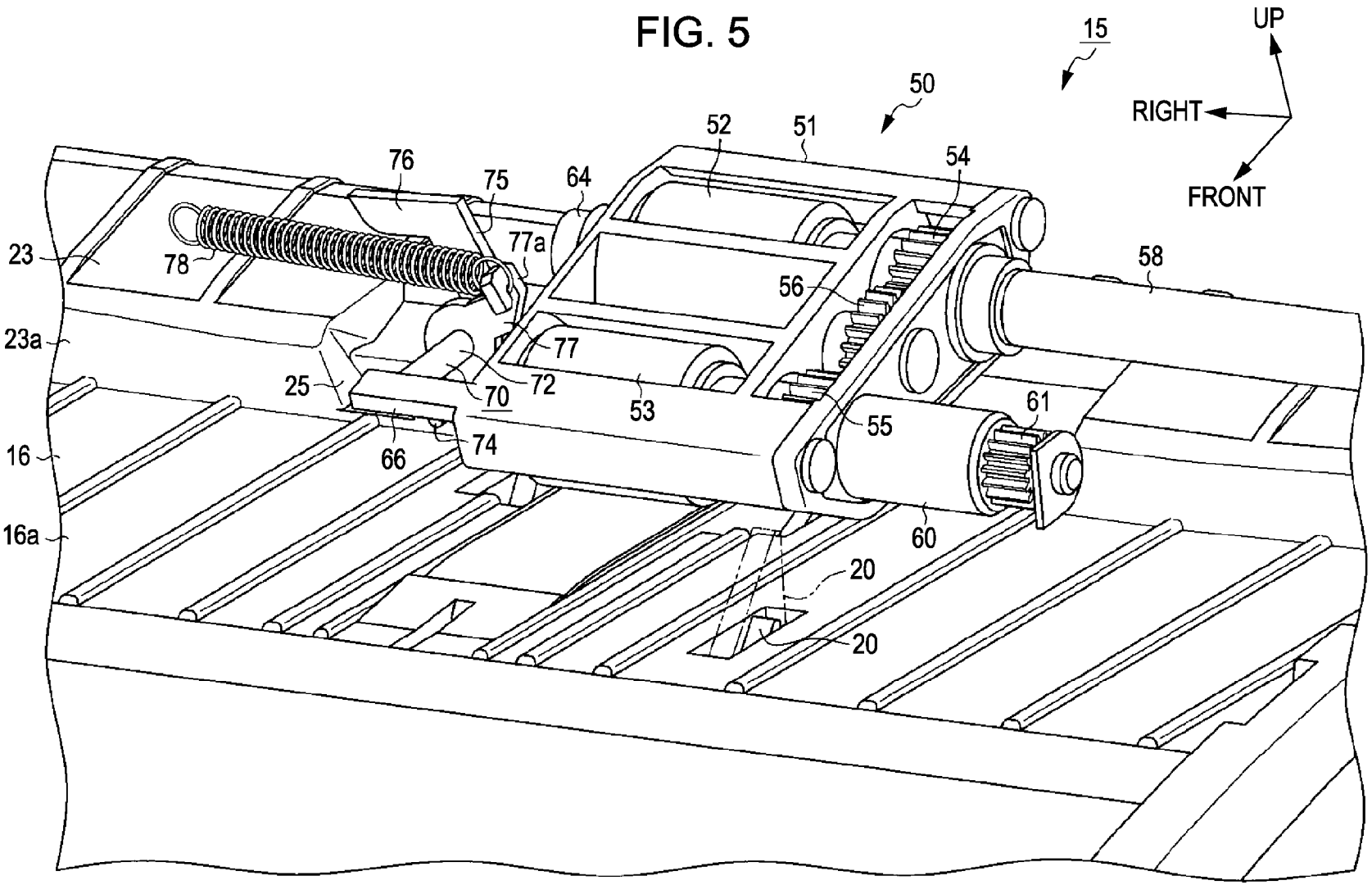
FIG. 5 is an enlarged perspective view of the main parts of the transport unit when the reverse cover is omitted and the feed roller unit is positioned at a feed position.

In this case, if the sub-shaft 60 is rotated in the normal direction as the second gear 55 is rotated in the normal direction, the sub-shaft gear 61 meshes with the rack (not shown) of the rear support plate 63 and is moved down along the rack while being rotated. Accordingly, the feed roller unit 50 is swung about the main shaft 58 so that the front portion of the feed roller unit is lower then the rear portion thereof. The feed roller unit is inclined so that the front portion of the feed roller unit is lower than the rear portion thereof, that is, the feed roller unit is in a state where the second feed roller 53 comes in contact with the set face 16*a* or the paper sheet P that is set on the set face 16*a* (see FIG. 5).

Accordingly, in this state, the feed roller unit 50 can feed the paper sheet P, which is set on the set face 16*a*, toward the downstream side of the transport path. In this case, the position of the feed roller unit 50 is referred to as a feed position. Meanwhile, the first detection lever 20 is disposed near a position where the second feed roller 53 of the feed roller unit 50 can come in contact with the set face 16*a* when the feed roller unit 50 is positioned at the feed position.

Meanwhile, if the main shaft 58 is rotated in the reverse direction when the feed roller unit 50 is positioned at the feed position, the first gear 54 is rotated in the reverse direction. Accordingly, the transmission gear 56 is rotated in the normal direction and the second gear 55 is rotated in the reverse direction. In this case, the torque of the first and second gears 54 and 55 is not respectively transmitted to the first and second feed rollers 52 and 53 by the first and second one-way clutches 57*a* and 57*b*. Further, in this case, if the sub-shaft 60 is rotated in the reverse direction as the second gear 55 is rotated in the reverse direction, the sub-shaft gear 61 meshes with the rack (not shown) of the rear support plate 63 and is moved up along the rack while being rotated. Accordingly, the feed roller unit 50 is displaced to the feed position.

Therefore, the feed roller unit 50 is displaced between the feed position and the non-feed position. That is, the feed roller unit 50 may be swung about the main shaft 58 between the feed position and the non-feed position.

As shown in FIGS. 2 to 4, a restricting member 70 made of a hard synthetic resin is disposed on the right side of the feed roller unit 50. The restricting member 70 is supported by a support arm 71 that is provided on the inner surface of the reverse cover 18. That is, the restricting member 70 includes a shaft 72 extending in the longitudinal direction that is the transport direction of the paper sheet P at the set position 24 and the shaft 72 is rotatably supported by the support arm 71.

A front connection portion 73, which extends straight upward so as to be slightly inclined toward the left side from the vertical direction, is integrally formed with the front end of the shaft 72. A columnar engagement portion 74, which extends in a straight line toward the front side, is integrally formed with the upper end of the front connection portion 73. Further, the engagement portion 74 comes in contact with the lower surface of the engagement arm 66 of the feed roller unit 50 that is positioned at the non-feed position.

Meanwhile, a rear connection portion 75, which extends straight toward the right side, is integrally formed with the rear end of the shaft 72. A plate-like restricting section 76, which extends straight toward the lower side, is integrally formed with the right end of the rear connection portion 75. The end (lower end) of the restricting section 76 is inserted into the recess 25. That is, when the feed roller unit 50 is positioned at the non-feed position, the end of the restricting section 76 is inserted into the recess 25 (see FIGS. 2 and 4). In this state, the restricting section 76 crosses the transport path of the paper sheet P in the vertical direction that is the thickness direction of the paper sheet P. For this reason, the restricting section 76 protrudes on the transport path of the paper sheet P, and blocks the transport path in the vertical direction without leaving a gap. Further, the position of the restricting member 70 in this case is referred to as a first position.

Furthermore, a locking portion 77, which extends straight upward in the vertical direction, is integrally formed with the shaft 72 at a position that is slightly closer to the rear side than the middle of the shaft 72 in the longitudinal direction. A hook 77*a*, which has a U shape in plan view, is formed at the upper end of the locking portion 77. One end of a coil spring 78, which functions as a pusher extending in the width direction, is caught by the hook 77*a*. The other end of the coil spring 78 is caught by a hook piece (not shown) that is formed on the inner surface of the reverse cover 18.

Further, if the feed roller unit 50 is displaced from the non-feed position to the feed position, the engagement portion 74 of the restricting member 70 is pressed down by the engagement arm 66 of the feed roller unit 50. In this case, the shaft 72 is rotated clockwise (as seen from the front side) against the pushing force of the coil spring 78 by the front connection portion 73, and the restricting section 76 is rotated clockwise (as seen from the front side) about the shaft 72 by the rear connection portion 75 with the rotation of the shaft 72. Accordingly, the restricting member 70 is in a state where the restricting section 76 is separated from the recess 25 and moved up (see FIG. 5), that is, the restricting section 76 retracts upward from the transport path of the paper sheet P. Further, the position of the restricting member 70 in this case is referred to as a second position.

Meanwhile, if the feed roller unit 50 is displaced from the feed position to the non-feed position, the shaft 72 of the restricting member 70 is rotated counterclockwise (as seen from the front side) by the pushing force of the coil spring 78. Accordingly, the shaft 72 is rotated counterclockwise (as seen from the front side) with the rotation of the shaft 72 so that the engagement portion 74 follows the engagement arm 66 of the feed roller unit 50. As a result, the restricting member 70 is again in a state where the restricting section 76 is inserted into the recess 25, that is, the restricting section 76 protrudes from the transport path of the paper sheet P from above.

The electrical configuration of the complex machine 11 will be described below.

Figure 6:
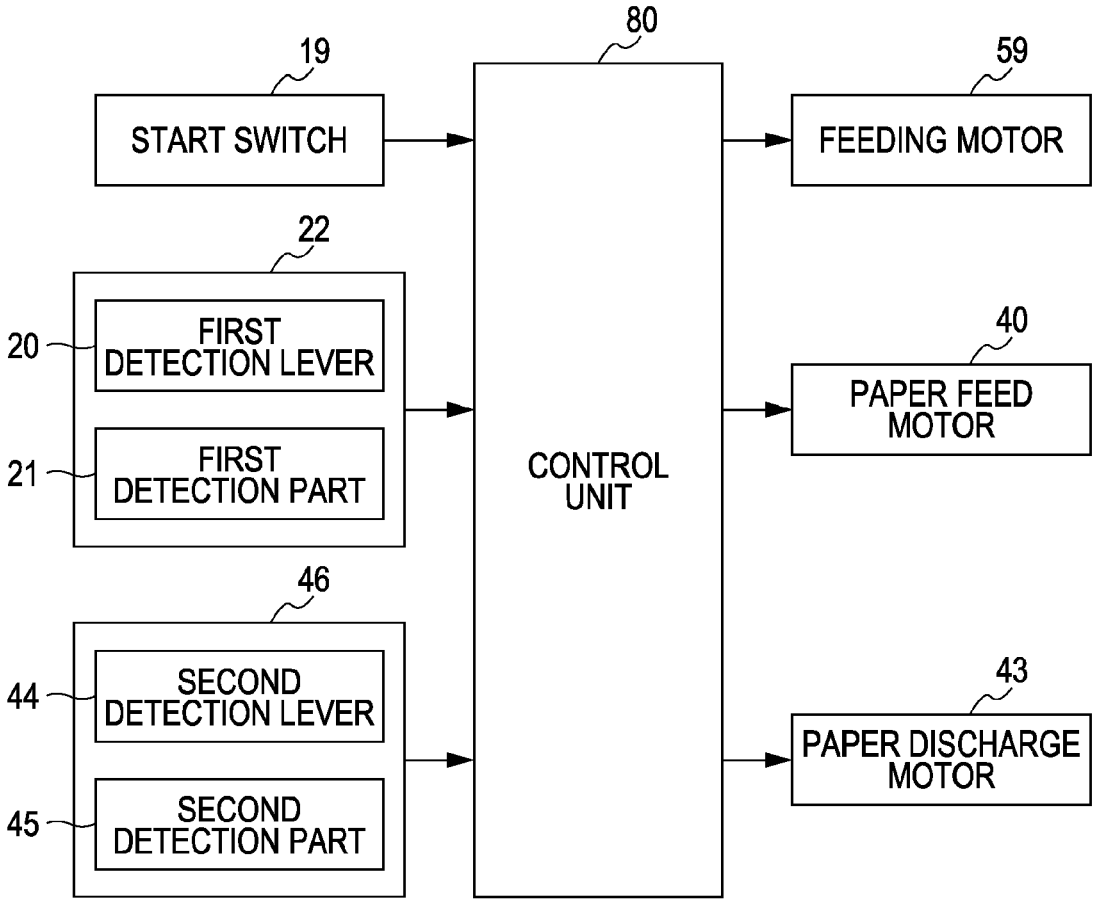
FIG. 6 is a block diagram showing the electrical configuration of the complex machine.

As shown in FIG. 6, the complex machine 11 includes a control unit 80, which functions as a controller for controlling the operation of the complex machine 11. The start switch 19, the paper sheet detecting sensor 22, the paper sheet-end sensor 46, the feeding motor 59, the paper feed motor 40, and the paper discharge motor 43 are electrically connected to the control unit 80. Further, an operation signal output when a user operates the start switch 19, an ON-detection signal or an OFF-detection signal that is output from the paper sheet detecting sensor 22, and an ON-detection signal or an OFF-detection signal that is output from the paper sheet-end sensor 46 are input to the control unit, so that the control unit 80 controls the driving of the feeding motor 59, the paper feed motor 40, and the paper discharge motor 43. Meanwhile, the control unit 80 includes a memory (not shown), and a program for transporting a paper sheet is stored in the memory.

The operation of the transport unit 15, when a user sets the paper sheet P on the set face 16*a* of the paper feed tray 16, will be described below.

The setting of the paper sheet P on the set face 16*a* is performed when the transport unit 15 is in a standby state. Accordingly, in this standby state, the feed roller unit 50 is positioned at the non-feed position, that is, the restricting member 70 is positioned at the first position. Further, in this state, a user inserts (pushes) by hand the stacked paper sheets P into the gap between the set face 16*a* and the feed roller unit 50 (toward the rear side) along the set face 16*a*. Accordingly, the front end of each paper sheet P comes in contact with the slope 23*a*, so that each paper sheet P is set into position.

Further, if each paper sheet P is vigorously inserted toward the rear side on the set face 16*a* by a user, the front ends of some paper sheets P among the paper sheets P get over the slope 23*a*. However, since the front ends of the paper sheets P getting over the slope 23*a* come in contact with the restricting section 76 of the restricting member 70, the paper sheets P do not get over the set position 24 toward the downstream side of the transport path. Accordingly, the front end of each paper sheet P is stopped at the set position 24.

Furthermore, if a user inserts each paper sheet P toward the rear side on the set face 16*a* by a very strong force, a strong pressing force is applied rearward to the restricting section 76 of the restricting member 70 from each paper sheet P inserted by the user. However, the restricting member 70 is rotatable about the shaft 72 extending in a direction where the transport path of the paper sheet P extends (herein, the longitudinal direction). Accordingly, the pressing force is not applied to the restricting member 70, which is positioned at the first position, in a rotational direction. That is, the pressing force is applied to the restricting member 70, which is positioned at the first position, in a direction substantially orthogonal to the rotational direction.

For this reason, the restricting force for restricting the front end of each paper sheet P, which gets over the set position 24 against the pressing force toward the downstream side on the transport path, depends not on the pushing force of the coil spring 78 but the strength of the material of the restricting member 70. Further, since the restricting member 70 is made of a hard synthetic resin in this embodiment, the strength of the restricting member is significantly higher than that of the paper sheet P. For this reason, a restricting force for restricting the front end of each paper sheet P, which gets over the set position 24 against the pressing force toward the downstream side on the transport path, is significantly secured.

Accordingly, when the paper sheet P is set in the paper feed tray 16, the front end of the paper sheet P, which gets over the set position 24 in the paper feed tray 16 toward the downstream side, is reliably restricted by the rotary restricting member 70.

Figure 7:
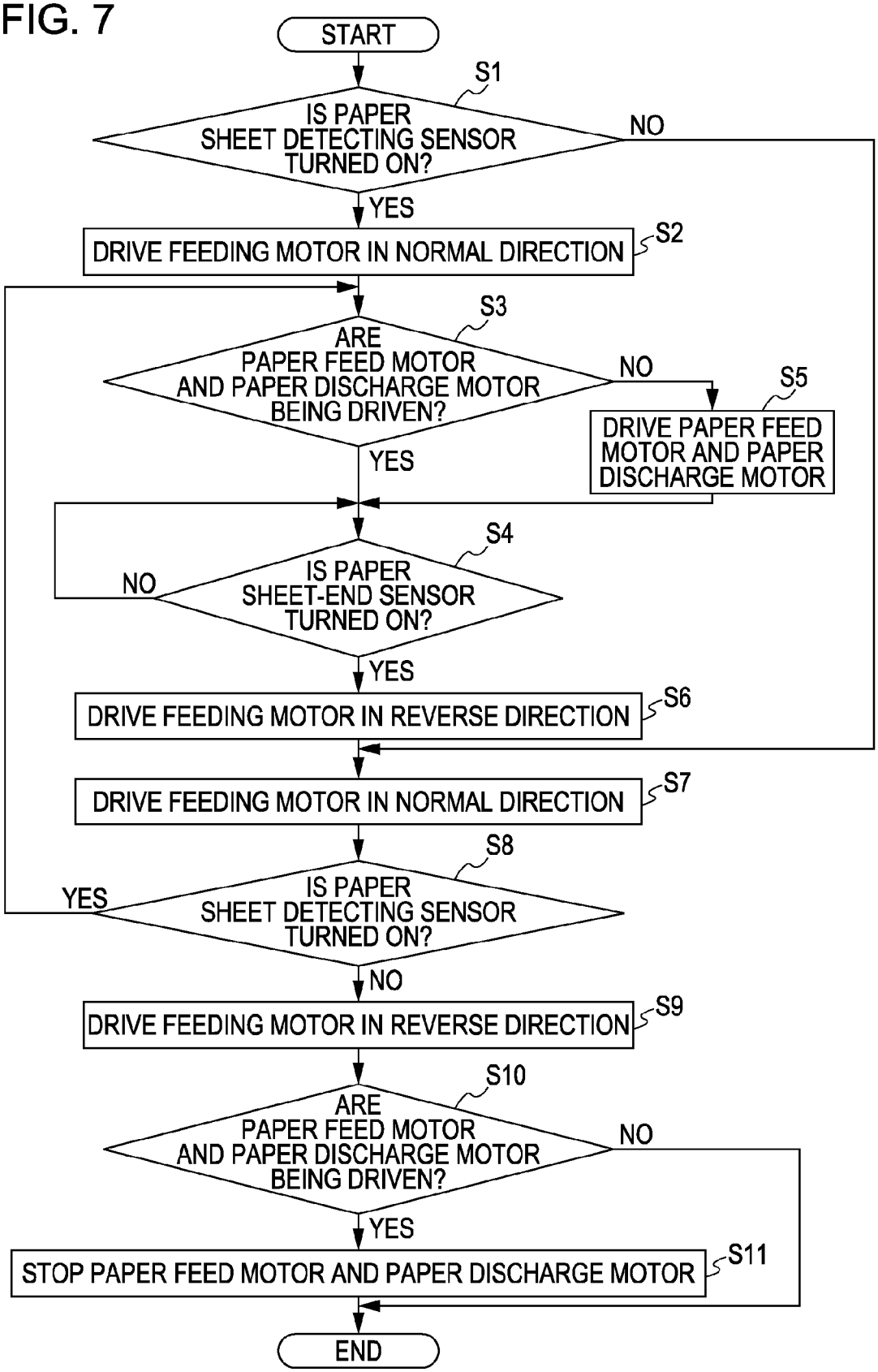
FIG. 7 is a flowchart illustrating a routine for transporting a paper sheet.

A routine for transporting the paper sheet, which is performed by a control unit 80 when a user operates the start switch 19, will be described below with reference to a flowchart of FIG. 7.

Meanwhile, if an operation signal is input to the control unit from the start switch 19, the control unit 80 determines whether an ON-detection signal is input from the paper sheet detecting sensor 22 (Step Si). If the determination result of Step Si corresponds to a positive determination, the control unit 80 drives the feeding motor 59 in the normal direction on the basis of the ON-detection signal input from the paper sheet detecting sensor 22 and displaces the feed roller unit 50 from the non-feed position to the feed position (Step S2). Then, the restricting member 70 is displaced to the second position from the first position, the second feed roller 53 comes in contact with the uppermost paper sheet P that is set on the set face 16*a* in a stacked state while being rotated in the normal direction, and the paper sheet P is fed toward the paper feed passage 35. That is, a feeding force is applied to the paper sheet P from the first and second feed rollers 52 and 53.

In this case, if a lower paper sheet P is led and moved by the uppermost paper sheet P, the uppermost paper sheet P and the lower paper sheet P are separated from each other when passing between the first feed roller 52 and the separation pad 79, so that only the uppermost paper sheet P is fed toward the paper feed passage 35. Meanwhile, if the determination result of Step S1 corresponds to a negative determination, the control unit 80 makes the process proceed to Step S7 to be described below on the basis of the OFF-detection signal input from the paper sheet detecting sensor 22.

Subsequently, the control unit 80 determines whether the paper feed motor 40 and the paper discharge motor 43 are driven (Step S3). If the determination result of Step S3 corresponds to a positive determination, the control unit 80 determines whether an ON-detection signal is input from the paper sheet-end sensor 46 (Step S4). Meanwhile, if the determination result of Step S3 corresponds to a negative determination, the control unit 80 drives the paper feed motor 40 and the paper discharge motor 43 (Step S5) and makes the process proceed to Step S4. Accordingly, the paper feed roller 38 and the paper discharge roller 41 are rotationally driven.

If the determination result of Step S4 corresponds to a negative determination, the control unit 80 repeatedly performs the process of Step S4 until the determination result of Step S4 becomes a positive determination. Meanwhile, if the determination result of Step S4 corresponds to a positive determination, the control unit 80 drives the feeding motor 59 in the reverse direction and displaces the feed roller unit 50 from the feed position to the non-feed position (Step S6). In this case, a feeding force, which is applied to the paper sheet P from the first and second feed rollers 52 and 53, is lost, but the transport of the paper sheet P has already left to the paper feed roller 38. Accordingly, the paper sheet P is transported without delay onto the upper surface 33*a* of the glass 33 by the paper feed roller 38. Further, when the paper sheet P passes between the upper surface 33*a* of the glass 33 and the paper sheet pressing member 32, the image is read by the scanner unit 14. After that, the paper sheet P passes through the paper discharge passage 37 and is discharged onto the paper discharge tray 17 by the paper discharge roller 41.

Subsequently, after driving the feeding motor 59 in the normal direction and displacing the feed roller unit 50 from the non-feed position to the feed position (Step S7) the control unit 80 determines whether an ON-detection signal is input from the paper sheet detecting sensor 22 (Step S8). Accordingly, Step S8 is performed while the feed roller unit 50 is positioned at the feed position.

In this case, if there are deformations, such as a wrinkle or warping, on the following paper sheet P on the set face 16*a* when Step S8 is performed while the feed roller unit 50 is positioned at the non-feed position, pressure is not sufficiently applied to the first detection lever 20 from the following paper sheet P. For this reason, even though the following paper sheet P exists on the set face 16*a*, an OFF-detection signal, not an ON-detection signal, is input to the control unit 80 from the paper sheet detecting sensor 22.

In this regard, in Step S8 of this embodiment the control unit determines whether an ON-detection signal is input from the paper sheet detecting sensor 22 when the feed roller unit 50 is positioned at the feed position. For this reason, if the following paper sheet P exists on the set face 16*a*, a portion of the paper sheet P corresponding to the first detection lever 20 is pressed from above by the second feed roller 53. Accordingly, even though there are deformations, such as a wrinkle or warping, on the paper sheet P on the set face 16*a*, pressure is sufficiently applied to the first detection lever 20 from the paper sheet P. For this reason, it may be possible to reliably avoid that an OFF-detection signal, not an ON-detection signal, is input to the control unit 80 from the paper sheet detecting sensor 22 despite the existence of the following paper sheet P on the set face 16*a*.

If the determination result of Step S8 corresponds to a positive determination, the control unit 80 makes the process proceed to Step S3 on the basis of the ON-detection signal input from the paper sheet detecting sensor 22. Meanwhile, if the determination result of Step S8 corresponds to a negative determination, the control unit 80 drives the feeding motor 59 in the reverse direction on the basis of the OFF-detection signal input from the paper sheet detecting sensor 22 and displaces the feed roller unit 50 from the feed position to the non-feed position (Step S9).

Subsequently, the control unit 80 determines whether the paper feed motor 40 and the paper discharge motor 43 are being driven (Step S10). If the determination result of Step S10 corresponds to a positive determination, the control unit 80 stops the paper feed motor 40 and the paper discharge motor 43 (Step S11) and then terminates the routine for transporting the paper sheet. Meanwhile, if the determination result of Step S10 corresponds to a negative determination, the control unit 80 terminates the routine for transporting the paper sheet.

According to the above-mentioned embodiment, it may be possible to obtain the following advantages.

(1) The restricting member 70 is rotatable about the shaft 72 extending along the transport path. Accordingly, even if the paper sheet P is strongly pushed toward the downstream side of the set position 24 in the transport direction by a user's manual operation, a pushing force in the rotational direction is not applied to the restricting member 70, which is positioned at the first position. For this reason, the restricting force for restricting the front end of the paper sheet P, which gets over the set position 24 against the pushing force toward the downstream side on the transport path, depends on the strength of the material (a hard synthetic resin in this embodiment) of the restricting member 70. Therefore, when the paper sheet P is set in the paper feed tray 16, it may be possible to reliably restrict the front end of the paper sheet P, which gets over the set position 24 in the paper feed tray 16 toward the downstream side, by the rotary restricting member 70.

(2) When the restricting member 70 is positioned at the first position, the restricting section 76 blocks the transport path of the paper sheet P in the thickness direction of the paper sheet P, which is set in the paper feed tray 16, without leaving a gap. Accordingly, it may be possible to further reliably restrict the front end of the paper sheet P, which gets over the set position 24 in the paper feed tray 16 toward the downstream side.

(3) The recess 25, into which the end of the restricting section 76 is inserted when the restricting member 70 is positioned at the first position, is formed at the set position 24 in the paper feed tray 16. For this reason, even though the restricting section 76 may be pushed to deform by the pushing force that is applied from the front side by the paper sheet P when the restricting member 70 is positioned at the first position, the end of the restricting section 76 is engaged with the rear surface of the recess 25. Accordingly, it may be possible to suppress the deformation of the restricting section 76, that is, to reinforce the restricting section 76.

(4) When the feed roller unit 50 is displaced to the feed position in order to feed the paper sheet P, the engagement portion 74 of the restricting member 70 is pressed by the engagement arm 66 of the feed roller unit 50, so that the restricting member 70 is positioned at the second position. Accordingly, the restricting section 76 reliably retracts from the transport path of the paper sheet P. For this reason, it may be possible to smoothly feed the paper sheet P, which is set in the paper feed tray 16, toward the downstream side of the set position 24 on the transport path by the feed roller unit 50. In this case, since an operation for displacing the restricting member 70 from the first position to the second position is performed by an operation for displacing the feed roller unit 50 from the non-feed position to the feed position, an actuator for displacing the restricting member 70 from the first position to the second position is not separately needed. Therefore, the number of components also does not need to be increased.

(5) In general, if there is warping or a wrinkle on the paper sheet P set in the paper feed tray 16 and the paper sheet P is thus deformed, the first detection lever 20 may not sufficiently receive pressure from the paper sheet P and the first detection lever 20 may not retract into the paper feed tray 16 despite the existence of the paper sheet P in the paper feed tray 16. Further, in this case, an OFF-detection signal is input to the control unit 80 from the paper sheet detecting sensor 22. Accordingly, there is a false detection that the paper sheet P does not exist in the paper feed tray 16. In this regard, in this embodiment, if an OFF-detection signal is input to the control unit 80 from the paper sheet detecting sensor 22 when the feed roller unit 50 is displaced from the non-feed position to the feed position and the feed roller unit 50 is positioned at the feed position, the control unit 80 determines that a paper sheet P does not actually exist in the paper feed tray 16 and then displaces the feed roller unit 50 from the feed position to the non-feed position. That is, when the feed roller unit 50 is positioned at the feed position, the paper sheet P set in the paper feed tray 16 is pressed from above by the feed roller unit 50. Accordingly, even though the paper sheet P is deformed, the first detection lever 20 reliably and sufficiently receives pressure from the paper sheet P. If an OFF-detection signal is input to the control unit 80 from the paper sheet detecting sensor 22 in this state, the control unit 80 determines that a paper sheet P does not actually exist in the paper feed tray 16 and then displaces the feed roller unit 50 from the feed position to the non-feed position. Accordingly, it may be possible to reliably avoid that an OFF-detection signal is input to the control unit 80 from the paper sheet detecting sensor 22 despite the existence of the following paper sheet P in the paper feed tray 16. As a result, it may be possible to reliably detect whether the paper sheet P set in the paper feed tray 16 exists or not.

(6) The first detection lever 20 of the paper sheet detecting sensor 22 is disposed near a position where the feed roller unit 50 can come in contact with the set face 16*a* when being displaced to the feed position. For this reason, even though the paper sheet P set on the set face 16*a* is deformed, the paper sheet P is pressed from above by the feed roller unit 50 when the feed roller unit 50 is displaced to the feed position. Accordingly, the first detection lever 20 reliably and sufficiently receives pressure from the paper sheet P. As a result, it may be possible to reliably and accurately detect by the paper sheet detecting sensor 22 whether the paper sheet P set on the set face 16*a* exists or not.

(Modification)

Meanwhile, the above-mentioned embodiment may be modified as follows:

Rubber may be used as the pusher instead of the coil spring 78.

The recess 25 may be omitted. In this case, when the restricting member 70 is positioned at the first position, the end of the restricting section 76 may come in contact with the stepped portion 23.

The restricting member 70 may be made of metal.

The engagement arm 66 of the feed roller unit 50 and the coil spring 78 may be omitted, and an actuator for displacing the restricting member 70 between the first and second positions may be separately provided.

A plastic film may be used as the sheet instead of the paper sheet P.

What is claimed is:

1. A transport device that transports a sheet set in a set section toward the downstream side on a transport path, the transport device comprising:

a feeding member that feeds the sheet set in the set section toward the downstream side on the transport path;

a stepped portion formed at an end of the set section in the downstream side of the transport path, the stepped portion extending over a width of the set section;

a restricting member disposed in the feeding member and forming a part of the stepped portion that is provided at a set position of the sheet in the set section, the restricting member being displaced to restrict the sheet moving toward the downstream side on the transport path;

a pusher disposed in the feeding member comprising a spring that applies a force to the restricting member so that the restricting member is positioned at a first position where the restricting member protrudes on the transport path;

a paper sheet detecting sensor which sends an ON-detection signal when the sheet is set in the set section and which sends an OFF-detection signal when the sheet is not determined to be set in the set section;

wherein the restricting member includes a restricting section that comes in contact with a front end of the sheet from the downstream side on the transport path, and is rotatable about a shaft extending along the transport path so as to be displaced between the first position and a second position where the restricting section retracts from the transport path, wherein the feeding member is displaced between a feed position where the feeding member feeds the sheet and a non-feed position where the feeding member does not feed the sheet, and when the feeding member is displaced from the non-feed position to the feed position, an engagement portion of the feeding member is engaged with the restricting member so as to cause the restricting member to resist the force of the pusher so that the restricting member is positioned at the second position, wherein upon receiving an OFF-detection signal from the paper sheet detecting sensor the feeding member is displaced from the non-feed position to the feed position, and wherein upon continuously receiving an OFF-detection signal from the paper sheet detecting sensor after the feeding member is displaced from the non-feed position to the feed position, it is determined that the sheet is not determined to be in the set section and the feeding member is displaced from the feed position to the non-feed position.

2. The transport device according to claim 1, wherein when the restricting member is positioned at the first position, the restricting section crosses the transport path in a thickness direction of the sheet set in the set section.

3. The transport device according to claim 1,wherein a recess, into which an end of the restricting section is inserted when the restricting member is positioned at the first position, is formed at the set position of the set section.

4. An image reading device comprising:

the transport device according to claim 1; and a reading unit that reads an image recorded on the sheet transported by the transport device.

5. An image forming apparatus comprising:

the image reading device according to claim 4; and a recording unit that records an image read by the image reading device.

6. The transport device according to claim 1, wherein a recess is formed at a part of the stepped portion.

* * * * *